United States Patent [19]

Bailey

[11] Patent Number: 4,524,599

[45] Date of Patent: Jun. 25, 1985

[54] ROTARY COMPRESSION BENDING MACHINE

[76] Inventor: Gregory W. Bailey, 48 Center St., Torrington, Conn. 06790

[21] Appl. No.: 423,676

[22] Filed: Sep. 27, 1982

[51] Int. Cl.[3] ..... B21D 9/03; B21D 9/05

[52] U.S. Cl. ..... 72/321

[58] Field of Search ..... 72/149, 321, 319, 370, 72/466, 219, 150, 217

[56] References Cited

U.S. PATENT DOCUMENTS

| | | | |
|---|---|---|---|
| 1,016,770 | 2/1912 | Persons | 72/466 |
| 3,147,792 | 9/1964 | Hautau | 72/150 |
| 4,012,933 | 3/1977 | Porter | 72/217 |

FOREIGN PATENT DOCUMENTS

| | | | |
|---|---|---|---|
| 1907759 | 8/1970 | Fed. Rep. of Germany | 72/321 |
| 59706 | 11/1912 | Switzerland | 72/466 |

*Primary Examiner*—E. Michael Combs
*Attorney, Agent, or Firm*—Brian L. Ribando

[57] ABSTRACT

A rotary compression bending machine comprises a radius die, a wiper die, and a flexible ball mandrel. Hydraulic cylinders are provided to simultaneously drive the wiper die around the radius die and to draw the ball mandrel through the tubing in order to reform the tubing while bending. The reformed tube will be wrinkle and distortion free around the bend radius.

6 Claims, 3 Drawing Figures

ROTARY COMPRESSION BENDING MACHINE

BACKGROUND OF THE INVENTION

Rotary compression benders are well known in the art. Such benders cannot easily perform a bend having a radius which is less than twice the diameter of the workpiece with certain thin wall materials such as stainless steel tubing, however, where it is desired that the finished bend be free of wrinkles or other deformations along the bend radius. Where the bent tubing is to be used for containing high pressure steam or in other severe applications, such deformations cause a back pressure in the tubing, can weaken the tubing, and can lead to catastrophic failure.

There is therefore a need for a bending machine and method which can be used with thin walled stainless steel tubing to produce a small radius bend which is free from distortion.

SUMMARY AND OBJECTS OF THE INVENTION

According to the invention, a flexible ball mandrel is used in conjunction with a rotary compression bending machine to create a substantially distortion free bend in thin wall tubing. The flexible ball mandrel is drawn through the tubing in order to cold work the tubing wall as the tubing is being bent.

It is, therefore, an object of the invention to provide a rotary compression bending machine used in conjunction with a flexible ball mandrel.

DESCRIPTION OF THE PREFERRED EMBODIMENT

Figure 1:
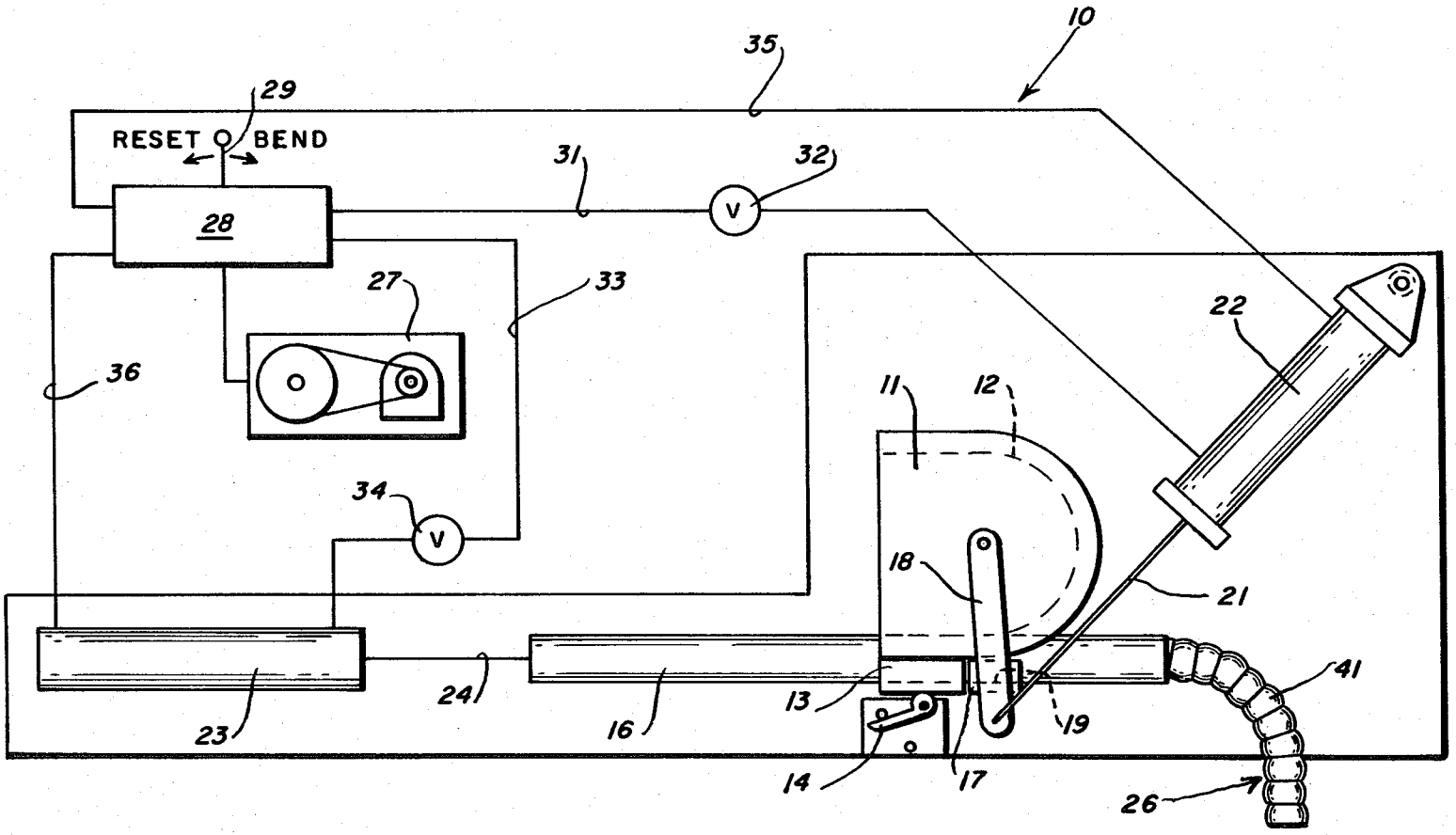
FIG. 1 is a schematic view of a rotary compression bending machine according to the invention.

FIG. 1 shows a rotary compression bending machine generally indicated by the reference numeral 10. The bending machine comprises a radius die 11 having a concave radius 12 formed around the working perimeter thereof. On one side of the radius die 11 is a clamp die 13 which is actuated by a locking lever 14 and is used to secure a workpiece such as a section of tubing 16 into the concave radius 12. A wiper die 17 is secured to a wiper arm 18 which is pivoted at one end to the center of the radius die 11. The wiper die 17 includes a concave wiper radius 19 which is the complement of the concave radius 12 on the radius die and is dimensioned to securely encompass the tubing 16.

The other end of the wiper arm 18 is attached to a rod 21 which is driven by a wiper cylinder 22. A mandrel cylinder 23 is coupled by a rod 24 to a flexible ball mandrel 26. Both the wiper cylinder 22 and the mandrel cylinder 23 are actuated by hydraulic fluid which is driven by a compressor 27. A master valve 28 in the hydraulic circuit includes a lever 29 which may be moved to either a Bend or a Reset position.

With the lever 29 in the Bend position, hydraulic fluid is admitted to the wiper cylinder 22 by means of the line 31 and to the mandrel cylinder 23 by means of the line 33. The line 31 includes a valve 32 used to control the amount of hydraulic fluid flow therethrough and the line 33 includes a valve 34 for the same purpose. When the control lever 29 is in the reset position, hydraulic fluid is supplied to the wiper cylinder 22 through the line 35 and to the mandrel cylinder 23 through the line 36.

According to the invention, the flexible ball mandrel 26 is drawn through the tube 16 by the mandrel cylinder 23 simultaneously with the bending of the tubing 16 caused by the motion of the wiper die 17 around the radius die 11. The simultaneous drawing of the individual balls of the ball mandrel through the tubing 16 as it is being bent around the radius die 11 causes the tubing wall to be reworked as the tubing is reformed from a straight section to a curve. The reworking eliminates any wrinkles or other discontinuities in the tubing wall as a result of the bending operation.

Figure 2:
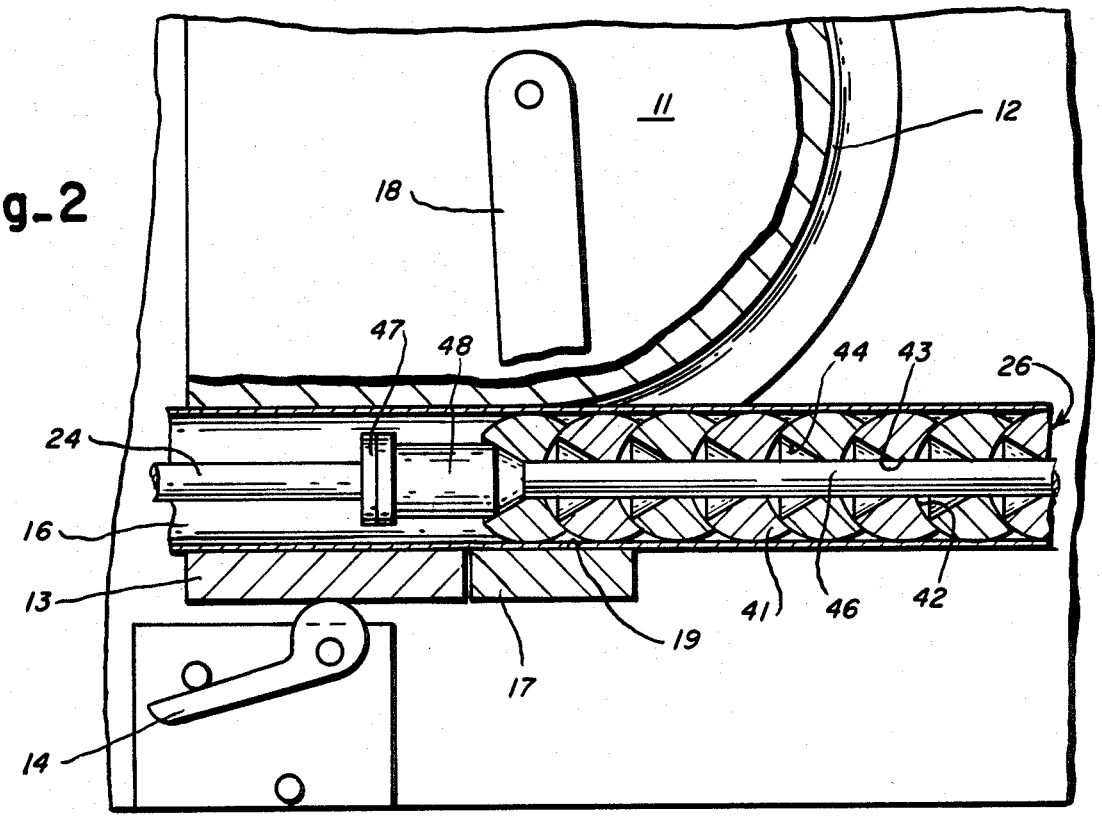
FIG. 2 is a view partly in section of thin wall tubing with a flexible ball mandrel in place for performing a bend.

Turning now to FIG. 2, it will be seen that the individual balls 41 of the flexible ball mandrel 26 fit closely within the tubing, and in practice, it has been determined that the clearance between the O.D. of the balls and the I.D. of the tubing should be about 0.002"–0.005". Each ball 41 includes a concave recess 42 and an axial bore 43 having a conical portion 44. A flexible cable 46 through each of the axial bores 43 joins the individual balls 41 into a continuous mandrel and the concave recesses 42 allow the balls to nest within one another. The cable 46 is provided with an enlargement (not shown) on one end to prevent the cable from slipping through the series of balls 41 and a coupling 47 joins the other end of the cable to the rod 24. A cushion block 48 abuts the end ball and the coupling 47 and maintains tension on the cable 46.

As shown in FIG. 2, at the beginning of the bending operation, one of the balls 41 of the ball mandrel 26 is positioned within the tubing 16 at that region of the tube which is encompassed by the wiper die 17. As the wiper arm is rotated counterclockwise by the wiper cylinder 22, the wiper die 17 follows an arcuate path around the radius die 11, and the tube will be forced into the radius surface 12 of the radius die 11. Simultaneous with the motion of the wiper die 17 and the subsequent bending of the tube 16, the flexible ball mandrel will be withdrawn by the mandrel cylinder 23 and will traverse the interior wall of the bent tubing in a clockwise direction. The close fit between the O.D. of the balls 41 and the I.D. of the tubing 16 will cause any wrinkles on the inside of the bend radius any any necking on the outside of the bend radius to be immediately reformed by the burnishing action of the balls 41 on the tubing interior wall. It has been found that the balls 41 may comprise a hard bronze alloy and that a lubricant may be used to lessen the friction between the mandrel and the tubing wall.

Figure 3:
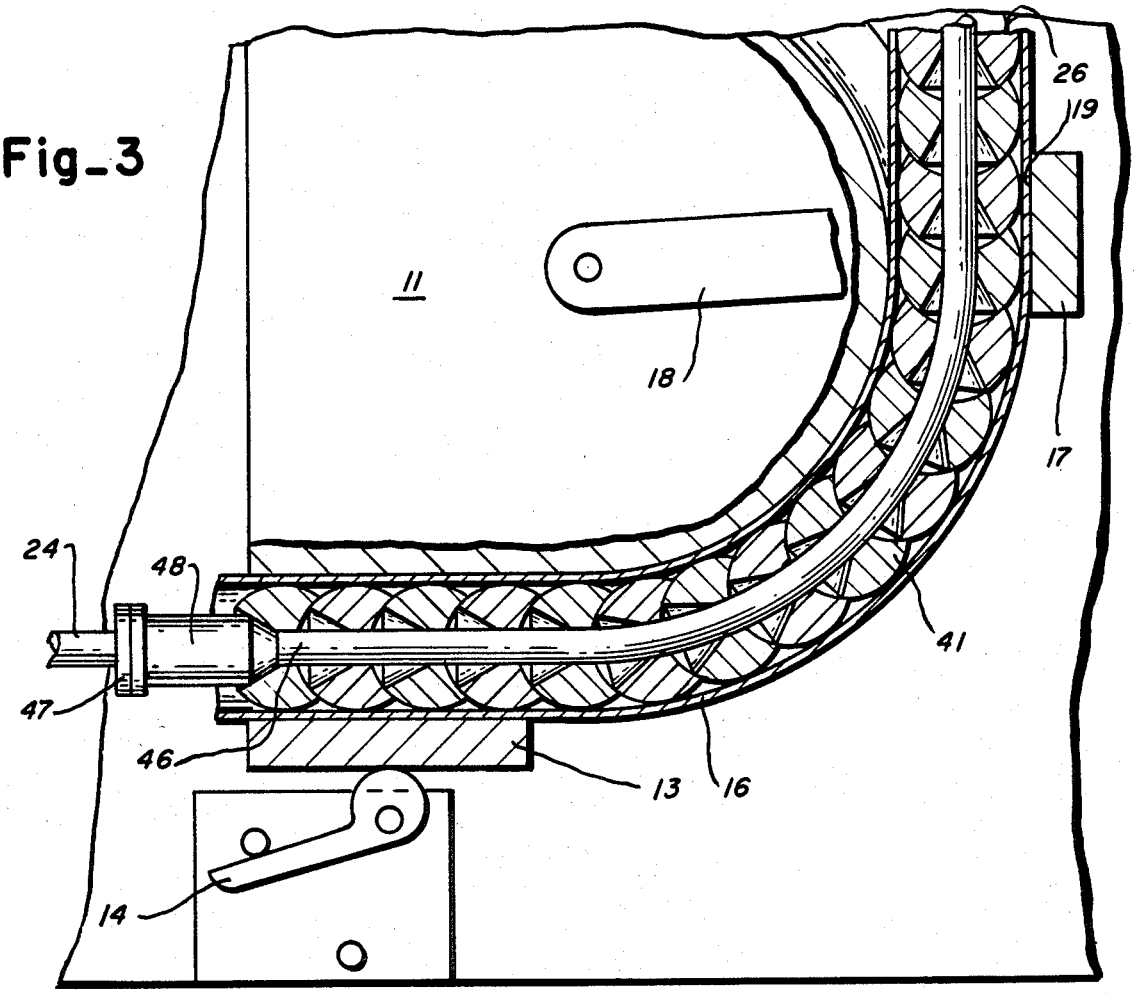
FIG. 3 is a view partly in section of the tubing and mandrel of FIG. 2 at the completion of the bending operation.

Turning now to FIG. 3, it will be seen that with the wiper die 19 displaced 90° from its initial position, the ball mandrel has been drawn through the tube in order to maintain the inner surface of the tube continuously smooth and distortion free. The conical portion 44 of the axial bores 43 allow the individual balls of the mandrel to follow the curve of the tubing, and a segment of the ball mandrel remains positioned in that region of the tube at which the bend is occurring, i.e. that portion which is encompassed by the wiper die 17. This ensures that at the end of the bend (in this case a 90° bend) the transition from the straight tube portion to the bent tube portion is smooth and continuous.

When used according to the invention, it has been found that the compression bending apparatus as shown produces smooth constant diameter tubing bends in difficult to bend tubing such as that made from thin walled (less than 1/16") stainless steel, and a bend having a radius of less than 3" can easily be made in 1½ "diameter tubing. The valve 32 in the line 31 coupled to the wiper cylinder 22 and the valve 34 in the line 33 coupled to the mandrel cylinder 23 are used to control relative amounts of flow to the cylinders. Controlling the flow amount controls the relative speed of travel of the wiper rod 21 and the mandrel rod 24. Experimentation has shown that various wiper rod/mandrel rod speed ratios may be advantageously utilized depending on tubing materials and bend radius. However, it is always necessary that some motion of the flexible ball mandrel take place at that point in the tube which is being bent by the wiper die in order to produce a bent tube which is free of distortion.

At the end of a Bend cycle, the clamp die 13 may be released and the tubing 16 can be withdrawn from the mandrel. Positioning the control lever 29 in the Reset position will cause the wiper arm 18 and the mandrel rod 24 to return to their initial positions. Those skilled in the art will recognize that gears or other means may be used to drive the wiper die around the radius die in order to produce bends greater than 90° in one operation.

Having thus described the invention, various alterations and modifications thereof will occur to those skilled in the art, which alterations and modification are intended to be within the scope of the invention as defined in the appended claims.

What is claimed is:

1. A rotary compression bending machine for bending thin wall tubing comprising:

a radius die having a concave radius around the working perimeter thereof, a clamp die for securing a length of tubing in engagement with the radius die, a wiper die mounted adjacent the working perimeter of the radius die for movement in an arcuate path therealong, a flexible ball mandrel comprising a plurality of spherical balls adapted to be positioned within the portion of the tubing which is to be bent, and means for driving said wiper die in an arcuate path in a first direction around the working perimeter of the radius die to bend said tubing therearound and for simultaneously drawing said flexible ball mandrel in an opposite direction through said tubing, at least one of said spherical balls being positioned with said tubing at the location on said tubing where said bend is taking place, whereby the motion of said flexible ball mandrel within said tubing reforms the tubing wall by burnishing to produce a bend in said tubing which is smooth and wrinkle free.

2. The rotary compression bending machine of claim 1, further comprising:

means for selectively varying the relative speed of the wiper die with respect to the speed of the flexible ball mandrel.

3. The rotary compression bending machine of claim 1, further comprising:

a flexible cable securing said plurality of spherical balls together, an axial bore in each ball for passage of said flexible cable therethrough, and a concave recess in each ball whereby said balls nest into one another.

4. The rotary compression bending machine of claim 3, further comprising:

means for selectively varying the relative speed of the wiper die with respect to the speed of the flexible ball mandrel.

5. The rotary compression bending machine of claim 1, wherein said means for driving said wiper die and said means for simultaneously drawing said flexible ball mandrel comprises hydraulic means.

6. The rotary compression bending machine of claim 3, further comprising:

a conical bore in each ball comprising a portion of said axial bore, whereby said balls are independently movable around a bend radius.

* * * * *